US005611116A

United States Patent [19]

Leifeld

[11] Patent Number: 5,611,116

[45] Date of Patent: Mar. 18, 1997

[54] FIBER BATT FEEDING APPARATUS FOR A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 450,314

[22] Filed: May 25, 1995

Related U.S. Application Data

[62] Division of Ser. No. 172,158, Dec. 23, 1993, Pat. No. 5,479,679.

[30] Foreign Application Priority Data

Dec. 23, 1992 [DE] Germany ..... 42 43 833.0
Oct. 6, 1993 [DE] Germany ..... 43 34 035.0

[51] Int. Cl.[6] ..... D01G 15/40

[52] U.S. Cl. ..... 19/105

[58] Field of Search ..... 19/0.23, 0.24, 19/204, 98, 105, 296; 73/159; 33/501.02, 501.03, 501.04

[56] References Cited

U.S. PATENT DOCUMENTS

| | | | |
|---|---|---|---|
| 4,506,413 | 3/1985 | Leifeld | 19/105 |
| 4,939,815 | 7/1990 | Leifeld | 19/105 |
| 5,014,395 | 5/1991 | Staheli et al. | 19/105 |

FOREIGN PATENT DOCUMENTS

| | | | |
|---|---|---|---|
| 2322942 | 4/1977 | France | 19/105 |
| 1118068 | 11/1961 | Germany . | |
| 4012551 | 6/1991 | Germany . | |
| 986979 | 1/1983 | U.S.S.R. | 19/105 |
| 956146 | 4/1964 | United Kingdom . | |
| 2189519 | 10/1987 | United Kingdom . | |
| 2190109 | 11/1987 | United Kingdom | 19/105 |
| 2198461 | 6/1988 | United Kingdom . | |

*Primary Examiner*—Michael A. Neas
*Attorney, Agent, or Firm*—Spencer & Frank

[57] ABSTRACT

An apparatus for feeding a fiber batt to a fiber processing machine includes a feed roll; a feed table formed of a plurality of separately movable feed table segments each cooperating with the feed roll and defining therewith a nip through which the fiber batt passes; a plurality of springs each being affixed to the feed table segment to form integral components therewith; and an elongated holding element extending spaced from, and generally parallel to the feed roll. Each spring is affixed to the holding element. The feed table segments are individually movable away from the feed roll against a force of respective springs in response to thickness variations in the fiber batt as the fiber batt passes through the nip. There is further provided a support for rotatably supporting the holding element. The feed table segments impart torques on the holding element through the respective springs as a function of movements of the feed table segments and the holding element is rotated by the torques to an extent representing a sum of the torques. A sensor is connected to the holding element for generating a signal as a function of rotary displacements of the holding element.

20 Claims, 10 Drawing Sheets

1
2
3
4
5
6
7
8
9
10
11
12
13
14a
14b
15
39

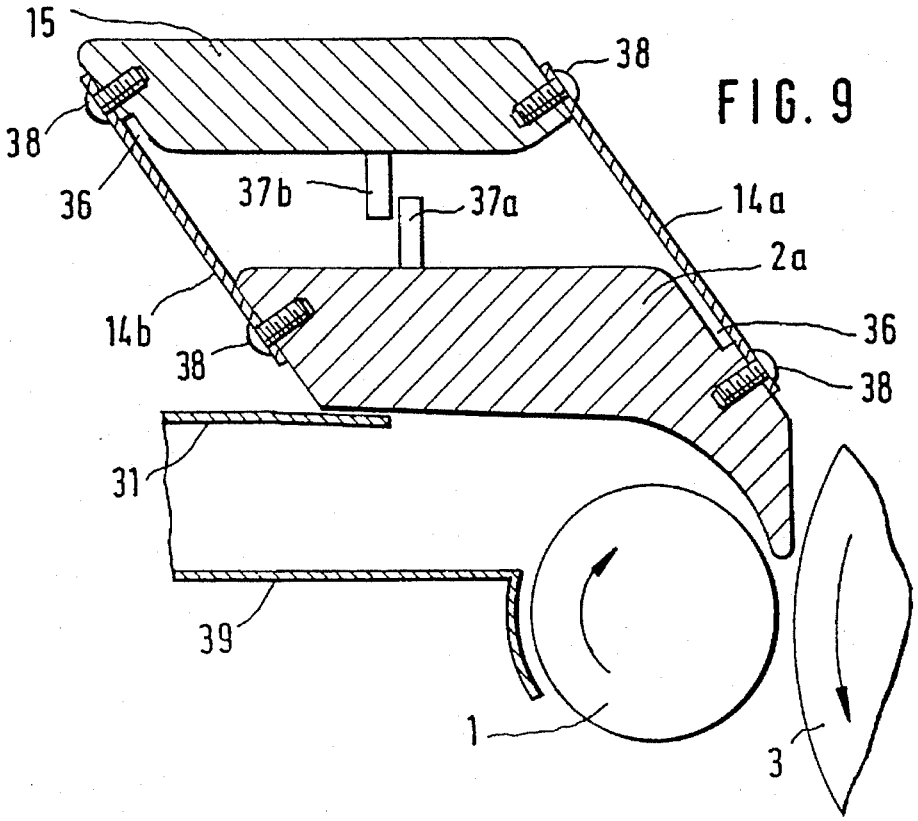
FIG. 9
FIG. 10
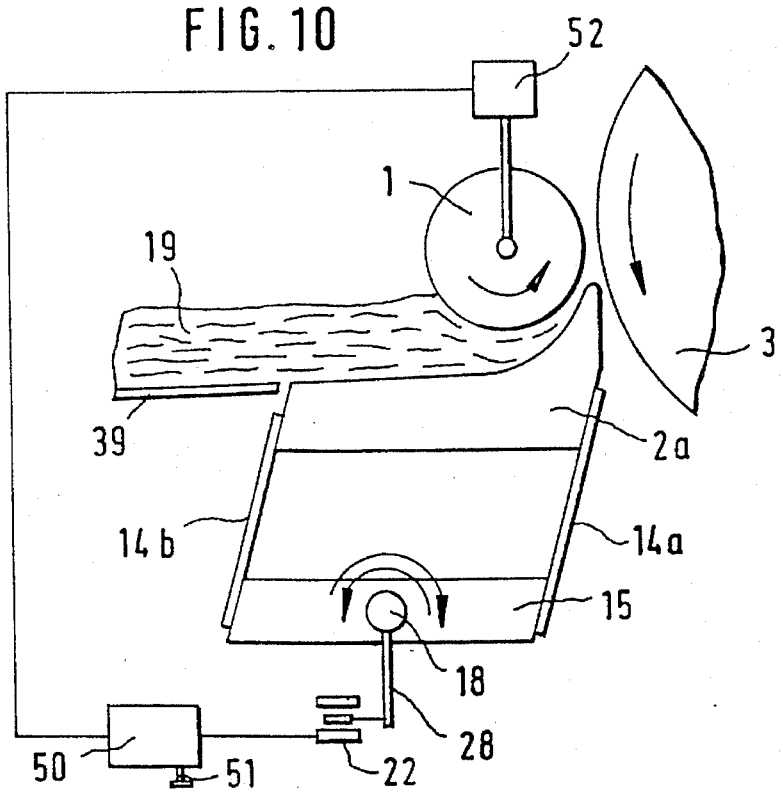

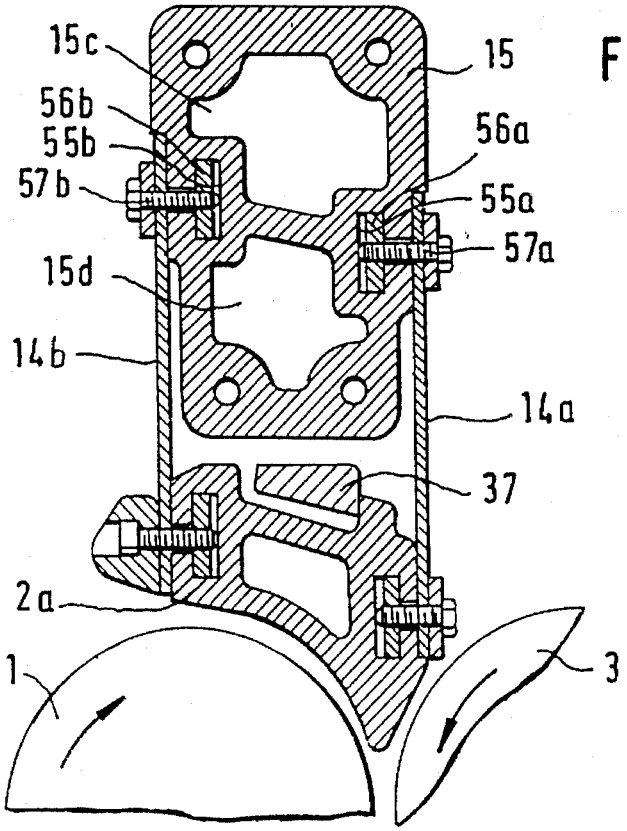
FIG. 12
FIG. 13
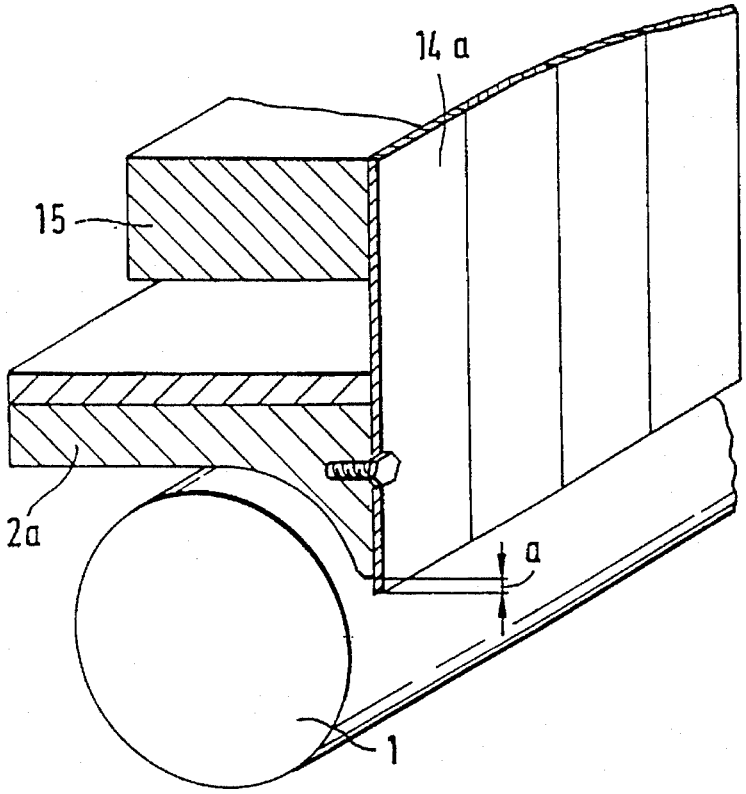

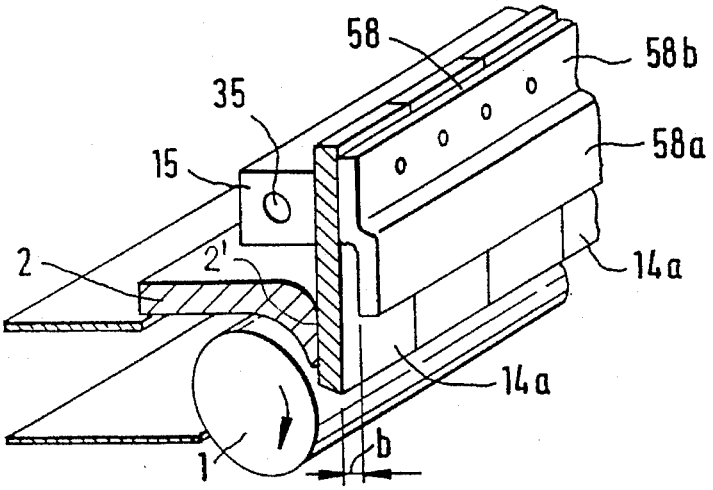
FIG.14
FIG.15a
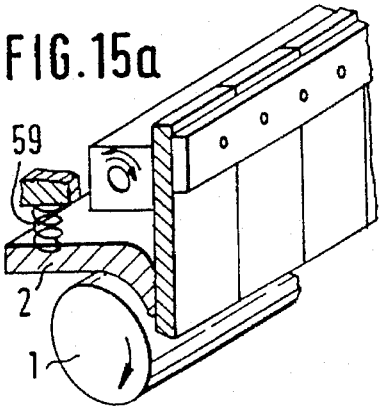
FIG.15b
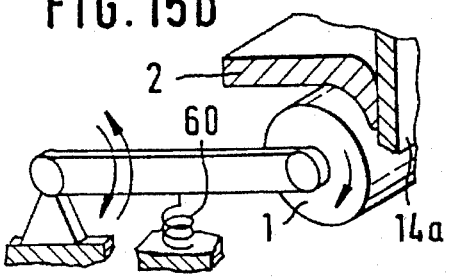
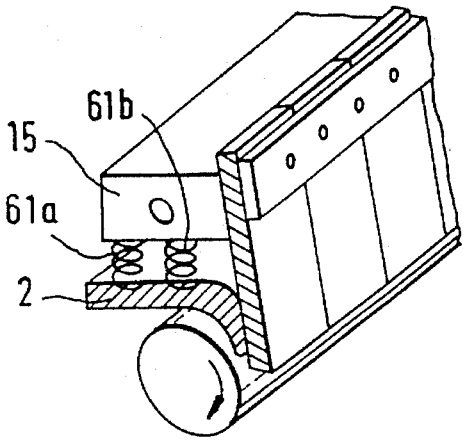
FIG. 16

FIG. 17
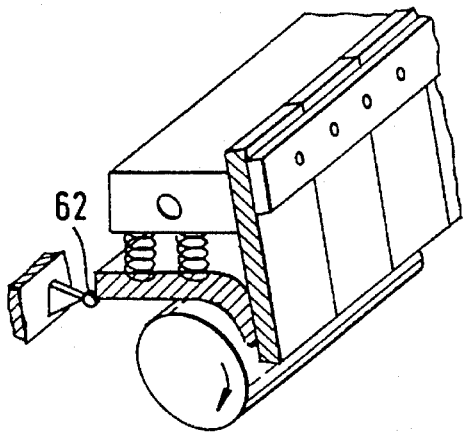
FIG. 18a
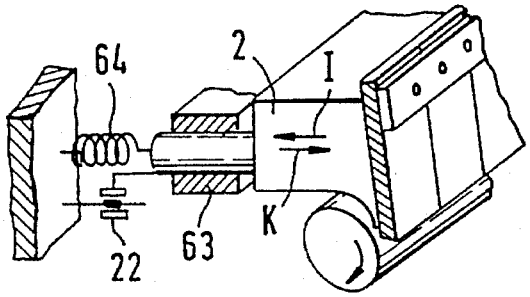
FIG. 18b
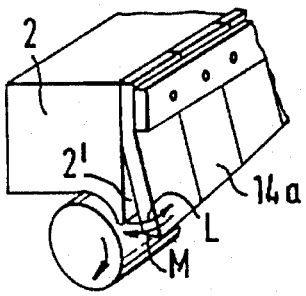
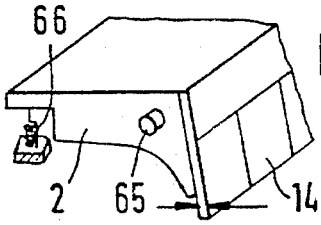
FIG. 19a
FIG. 19b
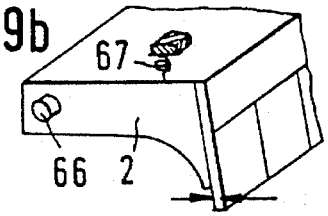
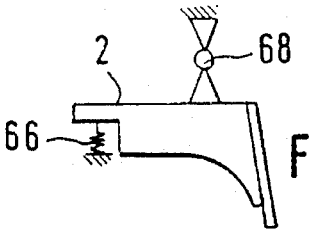
FIG. 19c
FIG. 19d
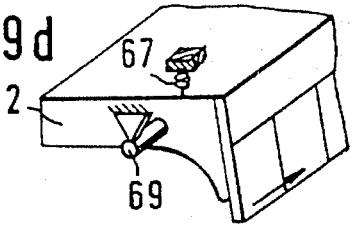

FIBER BATT FEEDING APPARATUS FOR A FIBER PROCESSING MACHINE

CROSS REFERENCE TO RELATED APPLICATION

This is a divisional of application Ser. No. 08/172,158 filed Dec. 23, 1995, now U.S. Pat. No. 5,479,679.

This application claims the priority of German Application Nos. P 42 43 833.0 filed Dec. 23, 1992 and P 43 34 035.0 filed Oct. 6, 1993.

BACKGROUND OF THE INVENTION

This invention relates to an apparatus for feeding a fiber tuft mass (fiber batt), composed of, for example, cotton fibers, synthetic fibers or the like, to a fiber processing machine, such as a carding machine or a cleaner to prepare the fiber for spinning. The apparatus has a fiber advancing mechanism formed of a feed roll and a cooperating feed table followed by at least one opening device such as an opening roll. The fiber advancing mechanism also serves as a batt thickness sensor. For this purpose the feed table is formed of a plurality of individually movable feed table segments which undergo excursions as the throughgoing fiber batt changes in thickness. Each movable feed table segment is biased towards the feed roll by a spring arrangement and is connected, with the intermediary of the respective springs, with a rotatably supported biased common holding element which senses the sum of the displacements of the individual feed table segments.

In a known apparatus of the above-outlined type, generally referred to as pedal-type or piano key-type regulating device, a fiber batt feeding aggregate and a rapidly rotating opening roll are arranged in series. The batt feeding aggregate is formed of a feed roll with feed table and upstream thereof (as viewed in the direction of fiber feed) there is arranged a sensor device having a fiber batt advancing roll cooperating with a plurality of sensor fingers. Thus, the sensing and feeding of the fiber material to the opening roll are spatially separated. By means of the sensor fingers the sensor device mechanically detects thickness variations of the fiber batt at several locations along the width of the fiber batt. Each sensor finger is an angled, two-arm lever rotatably held in its mid portion. The free end zone of one lever arm forms the sensor member proper, while at the free end zone of the other lever arm a tension spring is attached. In this manner each sensor finger is movably mounted for displacement in response to thickness variations in the fiber batt and each sensor finger is individually biased by its tension spring in such a manner that the sensor fingers press the fiber material against the feed roll. All tension springs are attached with one of their ends to one lever arm of a rotatably supported common two-arm summing lever. The other arm of the summing lever is attached to a weight, whereby to each sensor finger a fiber material pressing force is imparted with the intermediary of the tension springs and the summing lever. With the other lever arm of the summing lever an inductive proximity switch is associated which transforms excursions into electric pulses. A delayed, path-dependent shift register ensures that the corresponding regulating pulse affects the rotary speed of the downstream connected feed roll of the feed roll/feed table assembly (feeding assembly) for the opening roll only when the respective sensed areas of the fiber batt arrive in the working zone of the fiber feeding assembly.

It is a disadvantage of the above-outlined prior art construction that it is structurally complex and it is complicated to assemble. A great number of individual structural elements are required, for example, a separate rotary bearing has to be provided in order to support individually each sensor finger. Such rotary bearings are complex, expensive and they must be aligned with high precision. It is a further disadvantage of the prior art arrangement that the sensor fingers are separately connected with the common summing lever. Thus, the tension springs are needed as separate force-transmitting elements between the lever arms of the sensor fingers and the spaced lever arm of the summing lever. The individual tension springs are attached (hooked) at their ends with a certain clearance and their elongation may lead to tolerances and deviations which jeopardizes accurate measurements during operation. Particularly the determination of the sum of the thickness deviations is imprecise because the excursion of each individual sensor finger is measured indirectly. Because of the possibility of deviations in the tension springs, a uniform clamping of the fiber material along its width is adversely affected as well.

SUMMARY OF THE INVENTION

It is an object of the invention to provide an improved apparatus of the above-outlined type from which the earlier discussed disadvantages are eliminated, which is particularly structurally simple and makes possible an improved measurement and clamping of the fiber batt.

This object and others to become apparent as the specification progresses, are accomplished by the invention, according to which, briefly stated, the apparatus for feeding a fiber batt to a fiber processing machine includes a feed roll; a feed table formed of a plurality of separately movable feed table segments each cooperating with the feed roll and defining therewith a nip through which the fiber batt passes; a plurality of springs each being affixed to the feed table segment to form integral components therewith; and an elongated holding element extending spaced from, and generally parallel to the feed roll. Each spring is affixed to the holding element. The feed table segments are individually movable away from the feed roll against a force of respective springs in response to thickness variations in the fiber batt as the fiber batt passes through the nip. There is further provided a support for rotatably supporting the holding element. The feed table segments impart torques on the holding element through the respective springs as a function of movements of the feed table segments and the holding element is rotated by the torques to an extent representing a sum of the torques. A sensor is connected to the holding element for generating a signal as a function of rotary displacements of the holding element.

The invention provides an apparatus which is structurally simple and is uncomplicated to install and further makes possible an improved measurement (thickness sensing) and clamping of the fiber material. By the plurality of feed table segments an individual (zonewise separated) measuring and clamping of the fiber material along the entire width of the fiber batt is possible. Further, the mechanical summing is structurally simple; only a single sensor is required. It is a particular advantage of the invention that each feed table segment and the associated spring constitute an integral structural component. The spring has several functions: it firmly holds the feed table segment (securement of the segment), it holds the segment in position relative to the feed roll, and, being itself secured to the holding element, it also secures the segment to the holding element. Furthermore, as the segment undergoes an excursion in response to a thickness variation of the throughgoing fiber batt, it imparts a torque to the holding element, that is, it transfers the excursion of the segment directly to the holding element as a rotary motion. By virtue of the measures according to the invention, particularly by virtue of the integral construction of each segment and its spring on the one hand and the springs and the holding element, on the other hand, all excursions of the feed trays are transferred through a short path to the holding element simply, directly and immediately to thus sense the sum of the displacements. The apparatus is simple, because individual rotary bearings for the individual feed table segments are no longer needed. Furthermore, the apparatus is easy to install since there is no need to secure each individual segment via a spring but the entire apparatus may be installed as a single structural component.

The invention has the following additional advantageous features:

The spring is a leaf spring and with each feed table segment there is associated at least one leaf spring and is connected therewith by screws, rivets or an adhesive. By using leaf springs, the connection is particularly simple and permanent since relatively large surfaces are available for securement.

With each feed table segment there are connected two leaf springs which, as viewed in the direction of fiber feed, are attached at the upstream and downstream ends of the segments.

Each leaf spring is, at one end, firmly secured to the feed table segment and is, at the other end, firmly secured to the holding element.

The leaf springs for each feed table segment are spaced from one another in the direction of fiber feed.

The leaf springs are arranged parallel to one another.

The leaf springs are relatively stiff in the direction viewed parallel to the distance between feed table segment and holding element and are relatively soft in the direction viewed perpendicularly to a plane defined by such distance and the axis of the feed roll.

The holding element is a longitudinal beam oriented axially parallel to the feed roll.

The holding element is torsion resistant.

An axially extending torsion bar is attached to an end of the holding element. The torsion bar is biased by a spring or is itself a torsion spring.

The torsion bar is supported with a soft resilient force.

The torsion bar is supported in a stationary bearing.

The bias of the torsion bar is adjustable.

The holding element is, at one end, supported in a rotary bearing.

The torsion bar is associated with a measuring element for measuring the extent of the rotary displacement of the holding element.

The measuring element is an inductive path sensor.

The measuring element includes expansion measuring strips.

The feed table segments arranged along the length of the feed roll mechanically detect thickness variations of the fiber batt at various locations along the fiber batt width and the variations are, by means of the common holding element, combined into an average value of thickness variations.

Dependent upon the deviation Of an actual average value from a desired value, the fiber quantities (supply rate) to the fiber processing machine are varied.

The fiber feeding apparatus is, as a measuring and clamping device, arranged directly upstream of the opening roll. In this manner the feed table fulfills not only its usual role as a clamping device but has a dual function because it simultaneously serves as a measuring member so that additional devices for measuring the thickness fluctuations in the inlet zone of the fiber processing machine may be omitted.

The feed table segments are arranged above the feed roll.

The leaf springs project in the securing zone of the feed table segments into the nip between the slowly rotating feed roll and the rapidly rotating opening roll.

With the feed table segments there is associated a fixed abutment element which has a dual function: it prevents the feed table segments from contacting the feed roll and provides for a bias for the leaf springs.

The feed roll support is fixed.

The distance between the surfaces of the feed table segments and the circumferential surface of the feed roll decreases along the roll circumference viewed in the working direction.

The distance between the feed table segments on the one hand and the circumferential surface of the feed roll on the other hand is the smallest at the clamping location (nip).

The feed table segments are hollow extruded components. The cavity of the segments is coupled to a vacuum or air pressure source.

In the clearance between two adjoining feed table segments a seal is arranged.

BRIEF DESCRIPTION OF THE DRAWING

FIGS. 8 and 9 are sectional side elevational views of two further preferred embodiments of the invention.

FIG. 10 is a schematic side elevational view of a further preferred embodiment of the invention illustrating the feed table segments underneath the feed roll.

FIG. 12 is a sectional side elevational view of a further preferred embodiment of the invention.

FIGS. 13, 14, 15*a*, 15*b*, 16, 17, 18*a*, 18*b*, 19*a*, 19*b* and 19*d* are schematic perspective views of eleven further preferred embodiments of the invention.

FIG. 19*c* is a schematic side elevational view of yet another preferred embodiment of the invention.

DESCRIPTION OF THE PREFERRED EMBODIMENTS

Figure 1:
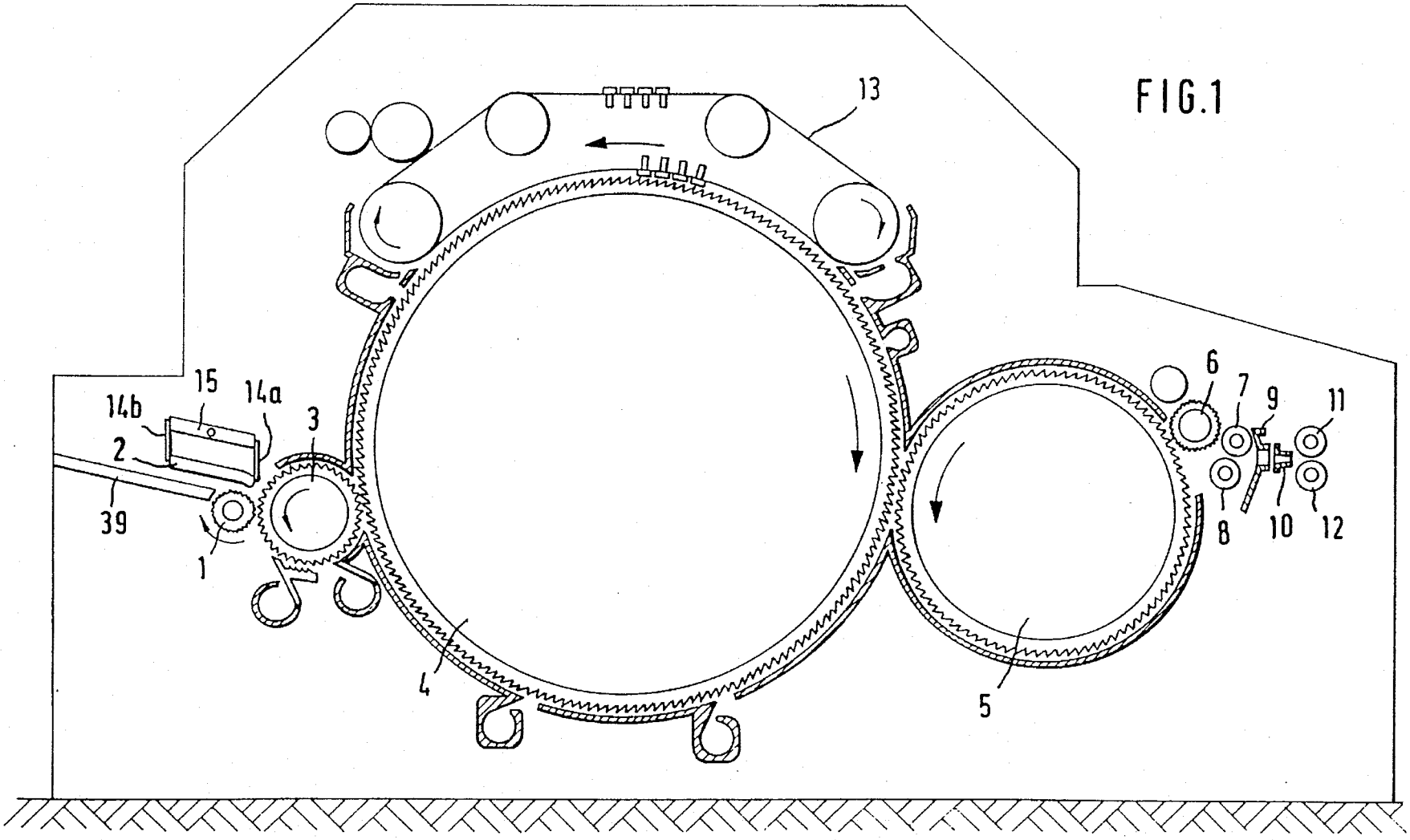
FIG. 1 is a schematic side elevational view of a carding machine incorporating the invention.

Turning to FIG. 1, there is illustrated therein a carding machine which may be, for example, an EXACTACARD DK 760 model, manufactured by Trützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, calender rolls 11 and 12 as well as travelling flats 13.

Figure 2:
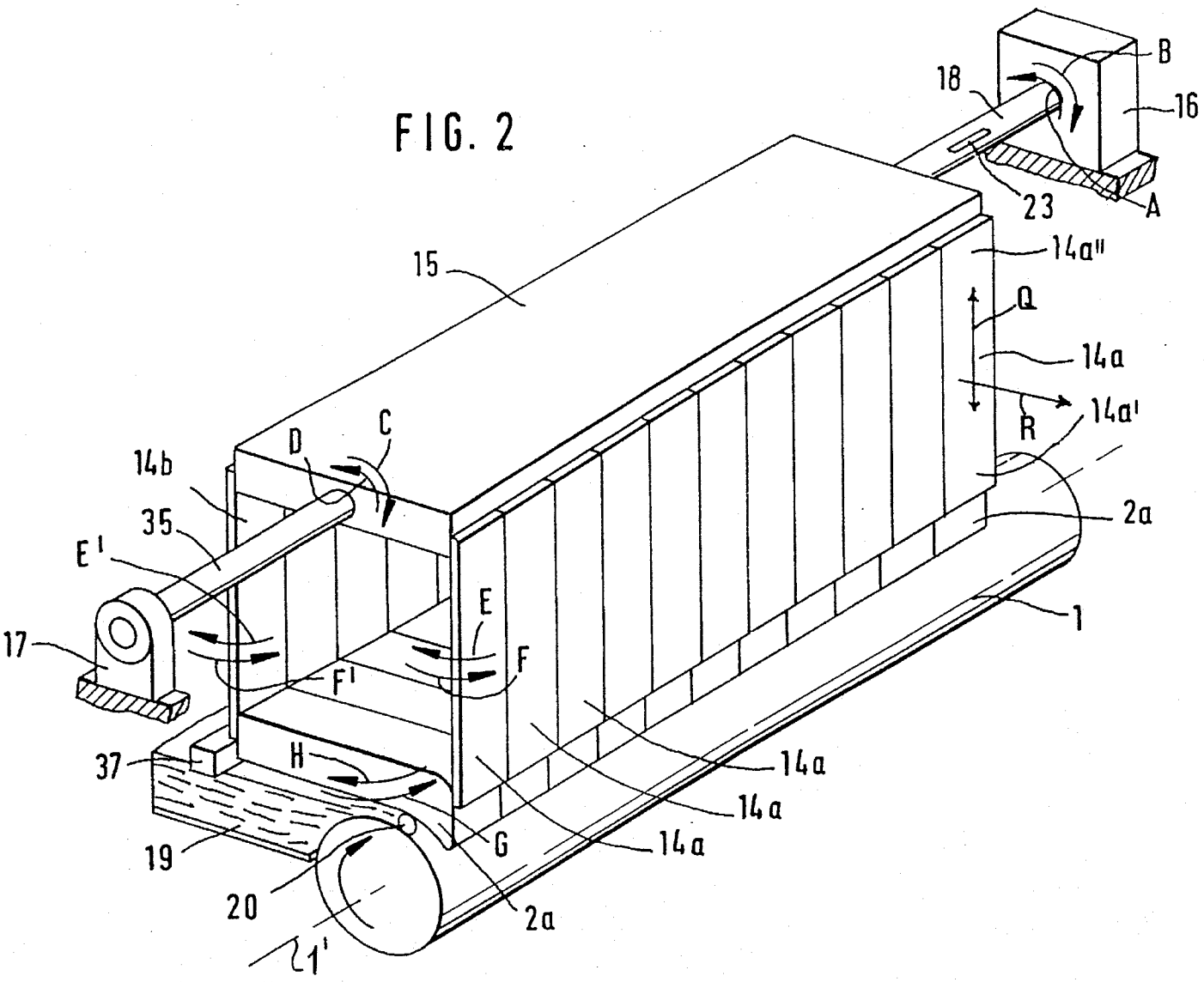
FIG. 2 is a perspective view of a preferred embodiment of the invention.
Figure 3:
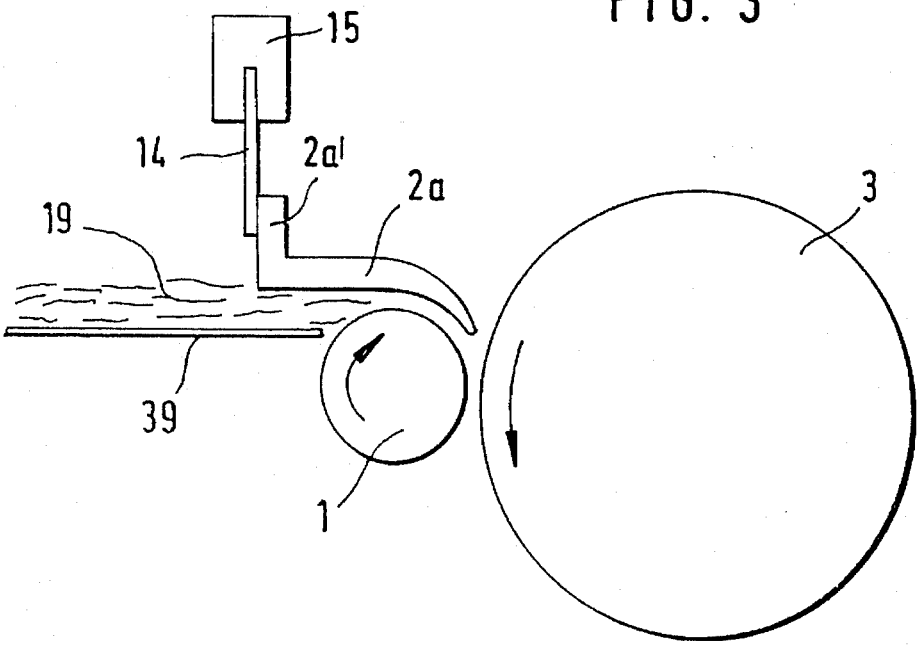
FIGS. 3 and 4 are schematic sectional side elevational views of two further preferred embodiments of the invention.

Turning to FIG. 2, above the feed roll 1 there are serially arranged feed table segments 2*a*, each being connected with a holding element 15—functioning as a summing beam—by means of an associated front leaf spring 14*a* and a rear leaf spring 14*b*. Each leaf spring has first and second zones of securement, such as 14*a*' and 14*a*" shown for the right-most spring 14*a* in FIG. 2. Each leaf spring is attached to a respective feed table segment 2*a* in the first zone of securement and to the holding element 15 in the second zone of securement. Each leaf spring is relatively hard in the direction Q which extends from the first to the second zone of securement and which is perpendicular to the rotary axis 1' of the feed roll 1, whereas each leaf spring is relatively soft in the direction R which is perpendicular to the direction Q and to the rotary axis 1' of the feed roll 1. The holding element 15, whose length dimension is oriented parallel to the rotary axis 1' of the feed roll 1, is provided at one end with a torsion bar 18 fixedly held in a stationary support 16. From the opposite end of the holding element 15 a shaft 35 extends which is movably supported in a bearing 17. Between the feed table segments 2*a* and the feed roll 1 a fiber batt 19 passes which, in the zone of the clamping location (nip) between feed roll and feed table segment has a thickened part 20, causing the feed table segment 2*a* to execute an excursion in the direction of the arrow G. By virtue of such an excursion the leaf springs 14*a* and 14*b* are moved in the directions of arrows F, F'. Such an excursion leads to a rotary motion of the holding element 15 in the counterclockwise direction as indicated by the arrow D, causing a torsional deformation of the torsion bar 18 in the direction of the arrow A, whereby the expansion measuring strips 23 are deformed and such a deformation may be represented by a signal. After regulation, the torsion effect is cancelled, that is, the torsion bar 18 and the holding element 15 rotate back in the direction of arrows B and C, respectively, the leaf springs 14*a*, 14*b* swing back in the direction of the arrows E, E' and the feed table segment 2*a* moves in the direction H into its initial position In the embodiment illustrated in FIG. 3, the holding element, that is, the summing (adding) beam 15 clampingly holds the springs 14 (only one visible). Each feed table segment 2*a* (only one visible) has at one end a foot 2*a*' affixed to the lower end of the respective spring 14.

Figure 4:
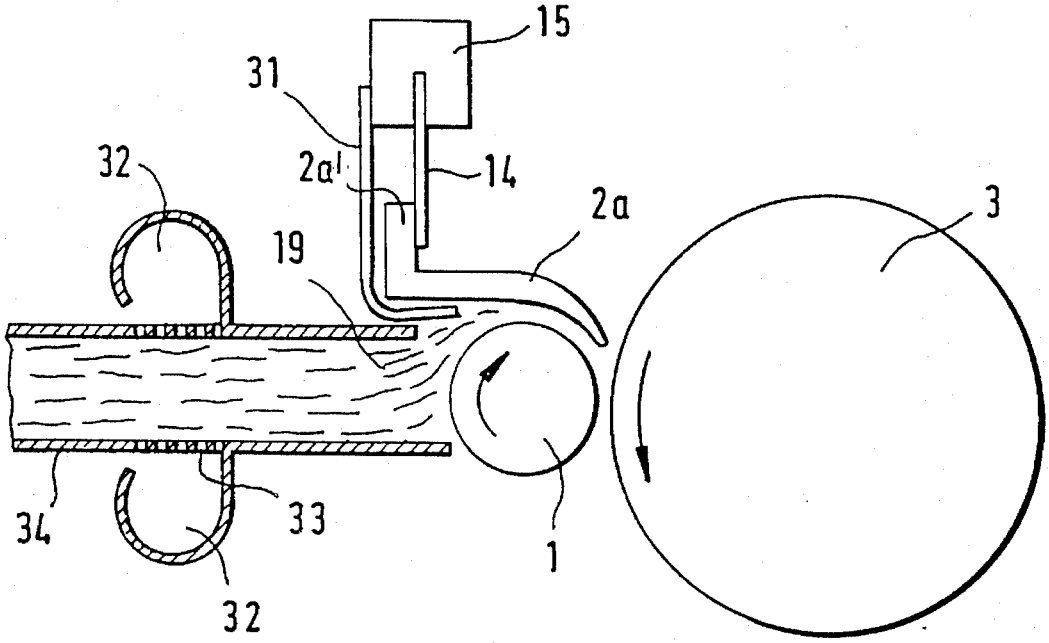

The embodiment according to FIG. 4 includes a channel 34 which extends from a non-illustrated card feeder and which opens in the fiber grasping zone formed of the feed roll 1 and the feed table segments 2*a*. The channel 34 has an apertured portion 33 shrouded by suction hoods 32. Similarly to FIG. 3, the feed table segments 2*a* have a foot 2*a*' and are connected by respective leaf springs 14 with the holding element 15. In the fiber intake zone a sealing flap 31 extends which at its upper end is secured to the holding element 15.

Figure 5:
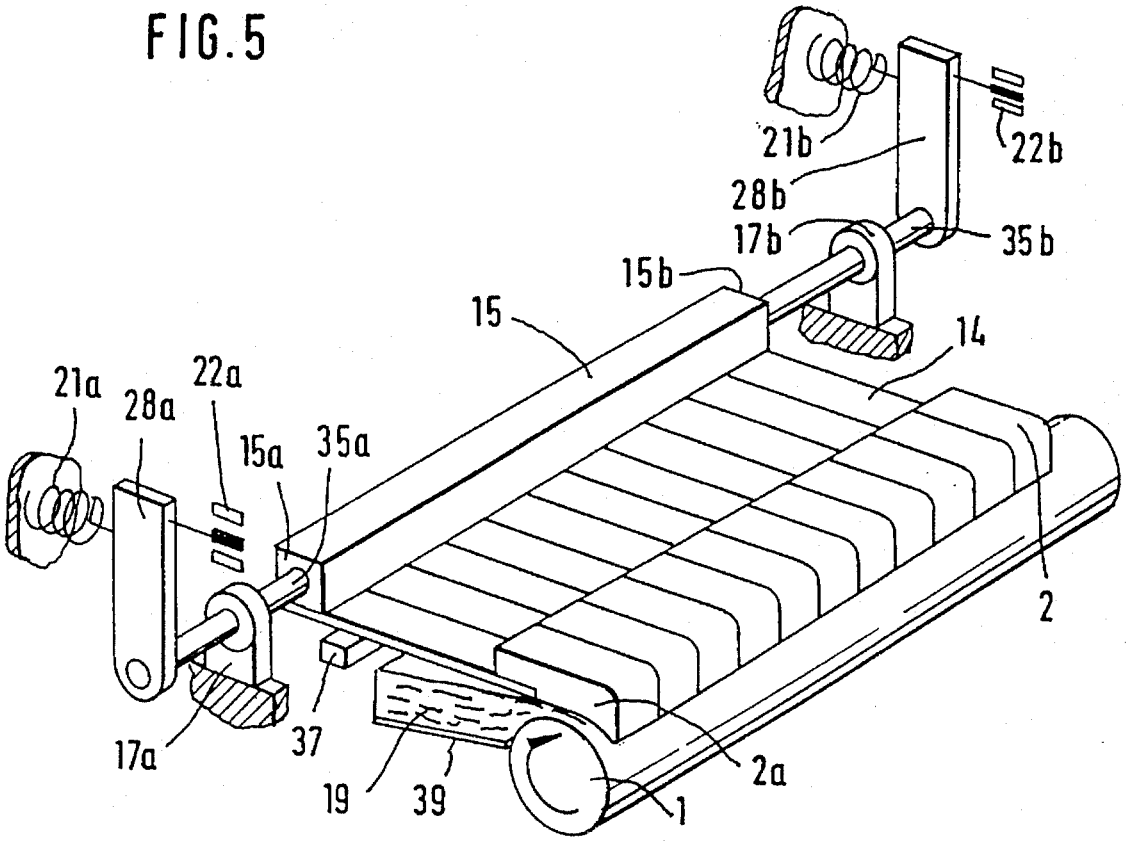
FIGS. 5, 6 and 7 are schematic perspective views of three further preferred embodiments of the invention.

In the embodiment illustrated in FIG. 5 the fiber batt 19 is advanced on a transfer tray 39 to the feed roll 1 above which the feed table segments 2*a* are supported by respective springs 14 which extend generally horizontally and are secured to the holding element 15. Underneath the springs 14 a rectangular abutment bar 37 extends parallel to the feed roll 1. The abutment bar 37 prevents the feed bar segments 2*a* from contacting the feed roll 1. The rear terminus of each leaf spring 14 is secured to the holding element 15 which is rotatably supported by bilaterally extending shafts 35*a*, 35*b* which, in turn, are rotatably held in bearing blocks 17*a*, 17*b*. At their extensions beyond the bearing blocks 17*a*, 17*b* the shafts 35*a*, 35*b* carry respective levers 28*a*, 28*b* which are biased in the direction of fiber feed by means of respective compression springs 21*a*, 21*b*. To each lever 28*a*, 28*b* there is connected a plunger armature of respective inductive path sensors 22*a*, 22*b* which emit a signal representing the extent of the displacement of the plunger armature.

Figure 6:
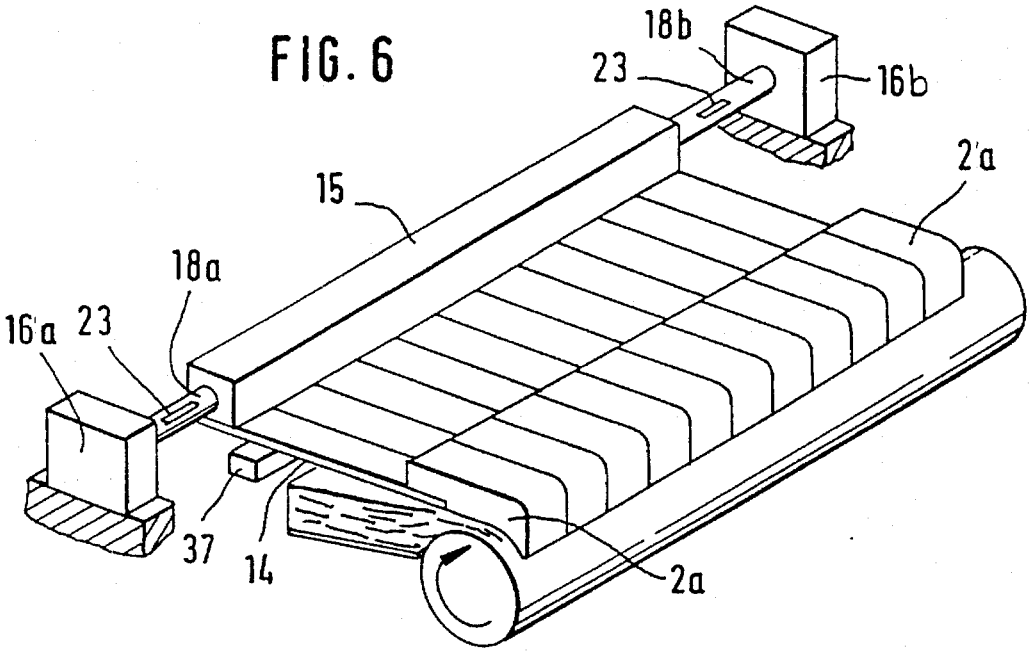

The embodiment illustrated in FIG. 6 is similar to that shown in FIG. 5 except that instead of shafts 35*a*, 35*b* shown in FIG. 5, the holding element 15 is, at each end, provided with torsion bars 18*a*, 18*b* which are held in fixed supports 16*a*, 16*b*, respectively. The torsion bars 18*a*, 18*b* carry expansion measuring strips 23 by means of which the motion, that is, the rotation of the holding element 15 is detected.

Figure 7:
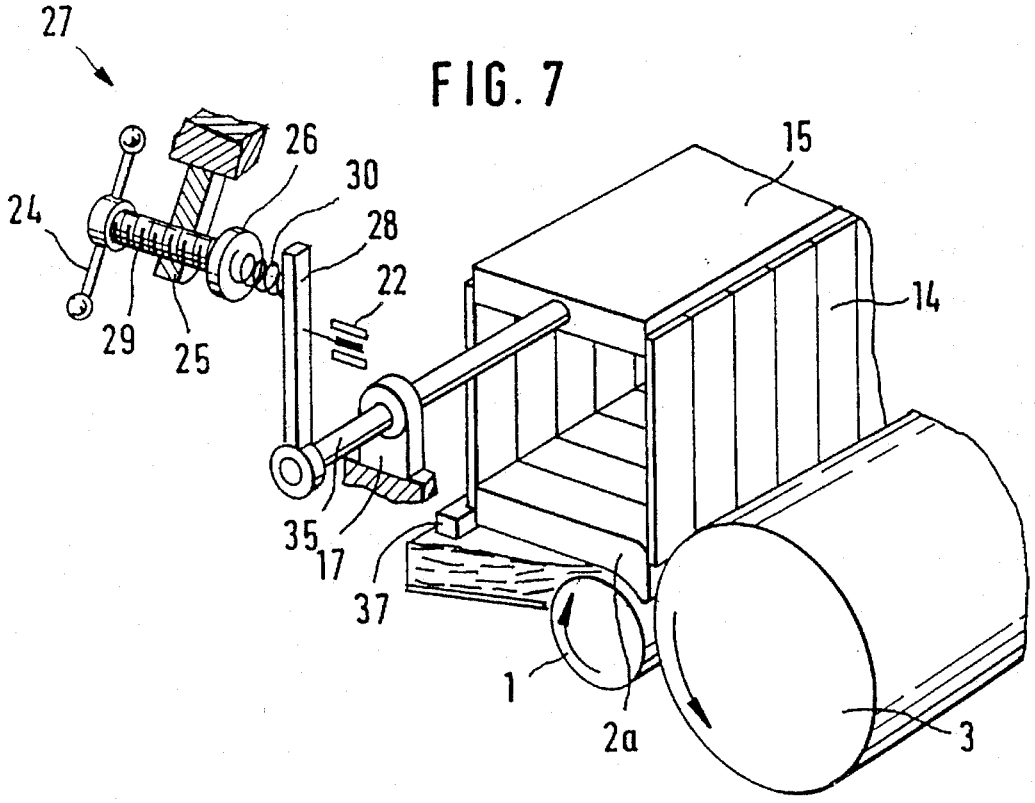

In the embodiment illustrated in FIG. 7 the construction which is similar to that of FIG. 5, also has a regulatable biasing device 27 which includes a stationary nut 25 affixed to the machine frame, a threaded spindle 29 threadedly engaging and passing through the nut 25, a pressure plate 26 carried at one end of the spindle 29 and a handwheel 24 attached to the opposite end of the spindle 29. The pressure plate 26 is connected with the loading arm 28 of the shaft 35 by means of a compression spring 30. The desired bias on the holding element 15 is thus adjustable by turning the handwheel 24. It will be understood that instead of the handwheel 24 a motorized adjusting mechanism may be used.

Figure 8:
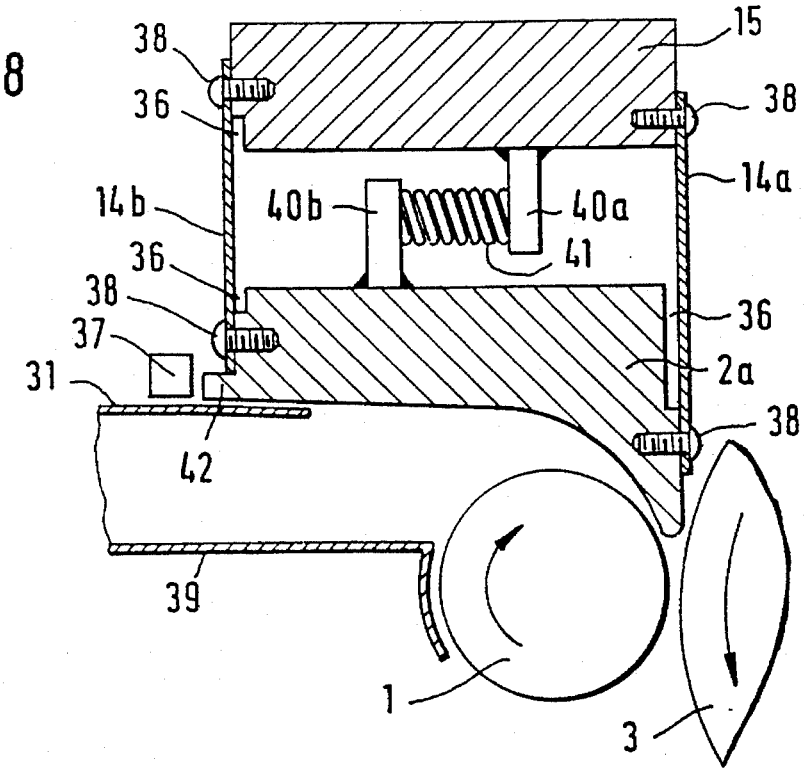

In the embodiment illustrated in FIG. 8 the frontal and rear leaf springs 14*a* and 14*b* are of different length and the frontal leaf springs 14*a* are so designed that they extend into the nip between the feed roll 1 and the licker-in (opening roll) 3. The leaf springs 14*a* and 14*b* are attached by screws 38 at their lower ends to the feed table segments 2*a* and at their upper ends to the holding element 15. The abutment bar 37 is mounted adjacent a projection 42 provided on a rear portion of each feed table segment 2*a*, and the clearance between the abutment bar 37 and each projection 42 is so designed that even in case of a bias the feed table segments 2*a* cannot contact the feed roll 1. To ensure that the leaf springs 14*a*, 14*b* do not enter into contact with the walls of the holding element 15 and the feed table segments 2*a* to thus allow an unimpeded motion of the feed table segments, the feed table segments 2*a* and the holding element 15 are provided with recesses 36 in the zone of the leaf springs 14*a*, 14*b*. On the underface of the holding element 15 a support bar 40*a* is carried whereas on the top face of each feed table segment 2*a* a support post 40*b* is arranged. Between each post 40*b* and the support bar 40*a* a spiral spring 41 is arranged which, in addition to the leaf springs 14*a* and 14*b* resiliently suspends the respective feed table segment 2*a* from the holding element 15.

In the embodiment illustrated in FIG. 9 the leaf springs 14*a* and 14*b* attaching each feed table segment 2*a* to the holding element 15 are inclined rather than in a perpendicular arrangement with respect to the segments 2*a* and the holding element 15 as it was the case in the earlier described embodiments. Further, the holding element 15 has along its entire length, that is, in a direction transversely to the advancing direction of the fiber material, an abutment bar 37*b* affixed to an underside thereof with which cooperate respective abutment posts 37*a* mounted on the top face of each feed table segment 2*a*. The distance between the abutment bar 37*b* on the one hand and the abutment posts 37*a* on the other hand is less than the width of the smallest clearance between the feed roll 1 and the feed table segments 2*a* to thus securely prevent any feed table segment 2*a* from contacting the feed roll 1.

In the embodiment illustrated in FIG. 10 the feed table segments 2*a* (only one visible) are arranged underneath the feed roll 1. Here too, the individual feed table segments 2*a* are connected with the holding element 15 by means of leaf springs 14*a*, 14*b*. The holding element 15 is at both ends connected with a torsion bar 18. A regulating device (microcomputer) 50 is provided, an input of which receives signals which represent the displacements of the torsion bar 18 and an output connected to the drive motor 52 of the feed roll 1 to regulate the speed of the feed roll 1 as a function of the thickness variations of the fiber batt 19 as it passes between the feed roll 1 and the feed table segments 2*a*.

Figure 11:
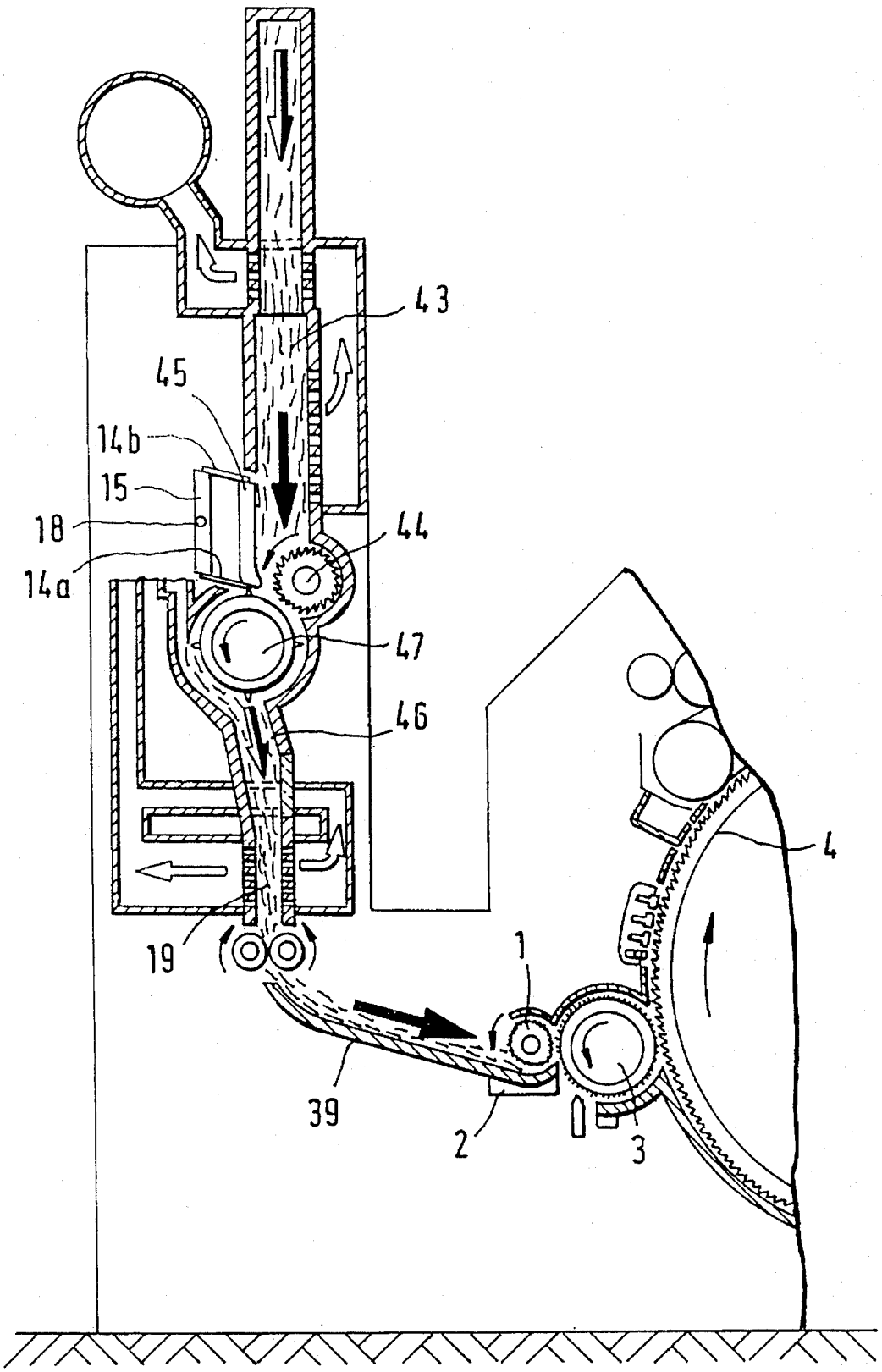
FIG. 11 is a sectional side elevational view of a pneumatic fiber tuft feeder incorporating the invention.

Turning to FIG. 11, there is illustrated a fiber tuft feeder which supplies a carding machine with the fiber batt 19. The fiber tuft feeder may be an EXACTAFEED FBK 533 model, manufactured by Trützschler GmbH & Co. KG, Mönchengladbach, Germany. The fiber material is pneumatically delivered in a fiber tuft conveying duct to the upper, reserve chute 43 and the material is driven downwardly by the air pressure onto a feed roll 44. The feed roll 44 cooperates with feed table segments 45 (only one segment is visible in FIG. 11), each being connected to a holding element 15 by separate leaf springs 14*a*, 14*b*. Upon thickness variations of the material passing between the feed table segments 45 and the feed roll 44 the respective feed table segment 45 is pushed away from the feed roll 44. Upon such occurrence, the leaf springs 14*a*, 14*b* bend and tend to rotate the holding element 15 in a clockwise direction as viewed in FIG. 11. The evaluation of the turning motion of the holding element is effected in a manner similar to the earlier-described embodiments. From the feed roll 44 the fiber batt 19 is admitted by means of an opening roll 47 into the feed chute 46 from which it is advanced onto the transfer plate 39 by a pair of cooperating withdrawing rolls.

In the embodiment illustrated in FIG. 12 the holding element 15 is a hollow extruded member, made for example of aluminum, having hollow spaces 15*c* and 15*d*. The oscillation behavior of the feed table segments 2*a* is an important consideration. If the segments 2*a* were imparted a frequency close to their natural frequency, they would start oscillating with a natural frequency which would present an uncontrolled movement which would endanger their function. Consequently, the natural frequency of the segments should be as high as possible. Since the natural frequency is primarily dependent from the own flexure, the weight must be held small. For this reason aluminum is selected for the holding element 15. The selection of a light-weight material for the holding element 15 is further advantageous because the reduced weight facilitates the installing operation. Also, the selection of aluminum allows production of the shape of the beam 15 by means of an extrusion process. This eliminates the need for mechanical shaping. Between the holding element 15 and the feed table segments 2*a* an abutment bar 37 is arranged.

An abutment bar 37 is provided between the holding element 15 and the feed table segments 2*a*. The abutment bar 37 extends in a space defined by outer top grooves provided in the feed table segments 2*a*. A cooperation between a side wall of the top grooves and the abutment bar 37 limits the excursion path for each feed table segment 2*a*. In the holding element 15 throughgoing grooves 55*a*, 55*b* are provided which have a T-shaped cross section and each accommodates a respective fastening rail 56*a*, 56*b* for fastening the leaf springs 14*a*, 14*b* by means of screws 57*a*, 57*b*.

In the embodiment shown in FIG. 13 the lower ends of the leaf springs 14*a* project downwardly beyond the lower end of the feed table segments 2*a* by a distance a. The leaf springs 14*a* which are made of hardened steel form in the zone of the narrow transition gap wear-resistant elements exerting a high pressing force. In this zone the leaf springs 14*a* are in direct contact with the fiber material.

The embodiment according to FIG. 14 has a one-piece feed table 2. The holding element 15 (summing beam) is also a throughgoing, one-piece element and is rotatably held with respect to the stationary machine frame for performing measurements. An abutment and securing strip 58 is provided, whose part 58*b* clamps a series of leaf springs 14*a* against the holding element 15, for example, by means of screw connections. The part 58*a* of the securing strip 58 is at a clearance b to the leaf springs 14*a* so that this zone 58*a* provides an abutment for the leaf springs 14*a* to limit their excursions away from the feed roll 1. The leaf springs 14*a* also serve as clamping springs for the fiber material. The free ends of the leaf springs 14*a* may swing away from the frontal face 2' of the feed table 2.

In the construction shown in FIG. 15*a* the one-piece feed table 2 is resiliently held relative to the machine frame. For this purpose a spring 59 is provided so that a deviation in case of thickness variations of the fiber batt and the generation of a signal for monitoring the material thickness and the regulation of the material supply is possible.

According to the embodiment illustrated in FIG. 15*b* the feed table 2 is stationarily held while the feed roll 1 is resiliently supported with the aid of a spring 60. With the feed table 2 leaf springs 14*a* are associated.

In the embodiment shown in FIG. 16 the feed table 2 is, with the aid of springs 61*a*, 61*b*, supported resiliently relative to the holding element 15.

In FIG. 17 which shows a structure similar to FIG. 16, the feed table 2 is at one end pivotally secured to the machine frame with the aid of a pivot bearing 62.

In the embodiment illustrated in FIG. 18*a* the feed table 2 is supported in a guide 63 allowing the feed table to execute horizontal displacements as indicated by the arrows I, K. This arrangement prevents a vertical motion component of the feed table and thus the inductive path sensor 22 senses only the horizontal displacements of the feed table 2. At one end of the feed table 2 a tension spring 64 is provided to urge the feed table in the direction of the arrow I and to thus provide a pressing force on the fiber material in cooperation with the feed roll 1. FIG. 18*b* illustrates the excursions of the leaf springs 14 of the FIG. 18*a* embodiment towards and away from the surface 2' of the feed table 2, as indicated by the arrows L and M.

FIGS. 19*a*–19*d* show various embodiments concerning the location of rotary support for the feed table 2. According to FIG. 19*a*, the feed table is supported at one end by means of springs 66. A pivot pin 65 is provided in the zone of the leaf springs 14*a* at the frontal end of the feed table 2 to be received in a bearing socket (not shown). In the structure according to FIG. 19*b*, the feed table 2 is supported by springs 67 in the zone of the leaf springs 14*a* at the frontal end and at the rear terminus the feed table 2 is rotatably supported by a pivot pin 66. FIG. 19*c* shows an embodiment similar to FIG. 19*a* in which, however, the pivotal support 68 is situated above the feed table 2. In FIG. 19*d* the construction is similar to that of FIG. 19*b* in which, however, the pivotal support 69 is situated in approximately the lateral middle of the feed table 2.

In the embodiments of FIGS. 18*a*, 19*a*–19*d* the excursion of the leaf springs 14*a* imparts a force on the feed table 2 which functions as a summing beam and whose linear shift (FIG. 18*a*) or rotation (FIGS. 19*a*–19*d*) is measured. It is noted that the springs 59, 60, 61*a*, 61*b*, 64, 66 and 67 are harder than the leaf springs 14*a* which form the sensor elements.

Advantageously, the apparatus may also be used as laboratory instrument for determining the cleanability of cotton.

It will be understood that the above description of the present invention is susceptible to various modifications, changes and adaptations, and the same are intended to be comprehended within the meaning and range of equivalents of the appended claims.

What is claimed is:

1. An apparatus for feeding a fiber batt to a fiber processing machine, comprising (a) a rotatably supported feed roll having a rotary axis;

(b) a feed table formed of a plurality of separately movable feed table segments arranged in a series along said feed roll; each feed table segment having a face portion cooperating with said feed roll and defining therewith a nip through which the fiber batt passes in an advancing direction;

(c) a plurality of springs each having a first zone of securement and a second zone of securement spaced from the first zone of securement; said springs being affixed at said first zone of securement to said feed table segments to form integral components therewith; each spring being relatively hard as viewed in a first direction and being relatively soft as viewed in a second direction; said first direction extending from said first zone of securement to said second zone of securement and being perpendicular to said rotary axis and said second direction being perpendicular to said first direction and to said rotary axis;

(d) an elongated holding element extending spaced from, and generally parallel to said feed roll; each said spring being affixed at said second zone of securement to said holding element, whereby said holding element resiliently supports said feed table segments by said springs; said feed table segments being individually movable away from said feed roll against a force of respective said springs in response to thickness variations in the fiber batt as the fiber batt passes through said nip;

(e) supporting means for rotatably supporting said holding element; said feed table segments imparting torques on said holding element through said respective springs as a function of movements of said feed table segments; said holding element being rotated by said torques to an extent representing a sum of said torques; and (f) sensor means connected to said holding element for generating a signal as a function of rotary displacements of said holding element.

2. The apparatus as defined in claim 1, wherein said supporting means comprises a stub shaft affixed to and extending from an end of said holding element and a rotary bearing receiving said stub shaft for rotation therein.

3. The apparatus as defined in claim 1, wherein said feed roll has a generally horizontal orientation and said feed table segments are situated above said feed roll.

4. The apparatus as defined in claim 1, further comprising a stationarily held abutment member cooperating with said feed table segments for preventing said feed table segments from contacting said feed roll.

5. The apparatus as defined in claim 1, wherein said feed table segments are hollow extruded members.

6. The apparatus as defined in claim 1, further comprising a drive motor connected to said feed roll and regulating means connected to said sensor means and said drive motor for varying an rpm of said feed roll as a function of a deviation of an actual batt thickness value from a desired batt thickness value.

7. The apparatus as defined in claim 1, wherein a distance of said face portion of said feed table segments from said feed roll decreases in said advancing direction.

8. The apparatus as defined in claim 7, wherein said distance is the smallest at said nip.

9. The apparatus as defined in claim 1, wherein said holding element is an extruded hollow member.

10. The apparatus as defined in claim 9, wherein said holding element is of a material selected from the group consisting of aluminum and an aluminum alloy.

11. An apparatus for feeding a fiber batt to a fiber processing machine, comprising (a) a rotatably supported feed roll;

(b) a feed table formed of a plurality of separately movable feed table segments arranged in a series along said feed roll; each feed table segment having a face portion cooperating with said feed roll and defining therewith a nip through which the fiber batt passes in an advancing direction;

(c) a plurality of springs each having a first zone of securement and a second zone of securement spaced from the first zone of securement; said springs being affixed at said first zone of securement to said feed table segments to form integral components therewith;

(d) an elongated, torsion-resistant holding element extending spaced from, and generally parallel to said feed roll; each said spring being affixed at said second zone of securement to said holding element, whereby said holding element resiliently supports said feed table segments by said springs; said feed table segments being individually movable away from said feed roll against a force of respective said springs in response to thickness variations in the fiber batt as the fiber batt passes through said nip;

(e) supporting means for rotatably supporting said holding element; said feed table segments imparting torques on said holding element through said respective springs as a function of movements of said feed table segments; said holding element being rotated by said torques to an extent representing a sum of said torques; and (f) sensor means connected to said holding element for generating a signal as a function of rotary displacements of said holding element; said sensor means comprising a torsion bar attached to an end of said holding element and being aligned with a longitudinal axis of said holding element.

12. The apparatus as defined in claim 11, further comprising means for fixedly supporting said torsion bar at an end thereof remote from said holding element.

13. The apparatus as defined in claim 11, further comprising a force-exerting means for applying to said torsion bar a resilient torque in a direction opposing the torques generated by displacements of said feed table segments away from said feed roll.

14. The apparatus as defined in claim 11, wherein said sensor means further comprises a measuring element for generating a signal as a function of torsional deformations of said torsion bar.

15. An apparatus for feeding a fiber batt to a fiber processing machine, comprising (a) a rotatably supported feed roll;

(b) a feed table formed of a plurality of separately movable feed table segments arranged in a series along said feed roll; each feed table segment having a face portion cooperating with said feed roll and defining therewith a nip through which the fiber batt passes in an advancing direction;

(c) a plurality of leaf springs each having a first zone of securement and a second zone of securement spaced from the first zone of securement; said springs being affixed at said first zone of securement to said feed table segments to form integral components therewith;

(d) an elongated holding element extending spaced from, and generally parallel to said feed roll; each said spring being affixed at said second zone of securement to said holding element, whereby said holding element resiliently supports said feed table segments by said springs; said feed table segments being individually movable away from said feed roll against a force of respective said springs in response to thickness variations in the fiber batt as the fiber batt passes through said nip;

(e) supporting means for rotatably supporting said holding element; said feed table segments imparting torques on said holding element through said respective springs as a function of movements of said feed table segments; said holding element being rotated by said torques to an extent representing a sum of said torques; and (f) sensor means connected to said holding element for generating a signal as a function of rotary displacements of said holding element.

16. The apparatus as defined in claim 15, wherein said springs are arranged in a generally coplanar series extending perpendicularly to said advancing direction.

17. The apparatus as defined in claim 15, wherein each said feed table segment has first and second ends spaced from one another parallel to said advancing direction; a separate said spring being attached to said first end and said second end.

18. The apparatus as defined in claim 17, wherein said springs attached to said first end of said feed table segments are arranged in a generally coplanar first series extending perpendicularly to said advancing direction and said springs attached to said second end of said feed table segments are arranged in a generally coplanar second series extending perpendicularly to said advancing direction.

19. An apparatus for feeding a fiber batt to a fiber processing machine, comprising (a) a rotatably supported feed roll;

(b) a feed table formed of a plurality of separately movable feed table segments arranged in a series along said feed roll; each said feed table segment having a longitudinal cavity; each feed table segment having a face portion cooperating with said feed roll and defining therewith a nip through which the fiber batt passes in an advancing direction;

(c) a plurality of springs each having a first zone of securement and a second zone of securement spaced from the first zone of securement; said springs being affixed at said first zone of securement to said feed table segments to form integral components therewith;

(d) an elongated holding element extending spaced from, and generally parallel to said feed roll; each said spring being affixed at said second zone of securement to said holding element, whereby said holding element resiliently supports said feed table segments by said springs; said feed table segments being individually movable away from said feed roll against a force of respective said springs in response to thickness variations in the fiber batt as the fiber batt passes through said nip;

(e) supporting means for rotatably supporting said holding element; said feed table segments imparting torques on said holding element through said respective springs as a function of movements of said feed table segments; said holding element being rotated by said torques to an extent representing a sum of said torques;

(f) sensor means connected to said holding element for generating a signal as a function of rotary displacements of said holding element; and (g) securing members anchored in said cavity and affixing said springs to said feed table segments.

20. An apparatus for feeding a fiber batt to a fiber processing machine, comprising (a) a rotatably supported feed roll;

(b) a feed table formed of a plurality of separately movable feed table segments arranged in a series along said feed roll; each feed table segment having a face portion cooperating with said feed roll and defining therewith a nip through which the fiber batt passes in an advancing direction;

(c) a plurality of springs each having a first zone of securement and a second zone of securement spaced from the first zone of securement; said springs being affixed at said first zone of securement to said feed table segments to form integral components therewith;

(d) an elongated holding element having a longitudinal cavity; said holding element extending spaced from, and generally parallel to said feed roll; each said spring being affixed at said second zone of securement to said holding element, whereby said holding element resiliently supports said feed table segments by said springs; said feed table segments being individually movable away from said feed roll against a force of respective said springs in response to thickness variations in the fiber batt as the fiber batt passes through said nip;

(e) supporting means for rotatably supporting said holding element; said feed table segments imparting torques on said holding element through said respective springs as a function of movements of said feed table segments; said holding element being rotated by said torques to an extent representing a sum of said torques;

(f) sensor means connected to said holding element for generating a signal as a function of rotary displacements of said holding element; and (g) securing members anchored in said cavity and affixing said springs to said holding element.

* * * * *